US012338696B2

(12) United States Patent
Seligman

(10) Patent No.: US 12,338,696 B2
(45) Date of Patent: Jun. 24, 2025

(54) LOW TORQUE WARNING TEST AND PRESET SYSTEM

(71) Applicant: Hawk Industries, Inc., Signal Hill, CA (US)

(72) Inventor: Mark Seligman, Signal Hill, CA (US)

(73) Assignee: Hawk Industries, Inc., Signal Hill, CA (US)

( * ) Notice: Subject to any disclaimer, the term of this patent is extended or adjusted under 35 U.S.C. 154(b) by 0 days.

(21) Appl. No.: 18/649,217

(22) Filed: Apr. 29, 2024

(65) Prior Publication Data

US 2024/0360730 A1 Oct. 31, 2024

Related U.S. Application Data

(60) Provisional application No. 63/462,555, filed on Apr. 28, 2023.

(51) Int. Cl.
*E21B 19/16* (2006.01)

(52) U.S. Cl.
CPC ..... *E21B 19/166* (2013.01)

(58) Field of Classification Search
CPC ..... E21B 19/166
See application file for complete search history.

(56) References Cited

U.S. PATENT DOCUMENTS

| | | | | |
|---|---|---|---|---|
| 4,163,401 | A | 8/1979 | Sheldon et al. | |
| 4,727,781 | A | 3/1988 | Yuehui et al. | |
| 6,722,231 | B2 | 4/2004 | Hauk et al. | |
| 6,745,646 | B1 | 6/2004 | Pietras et al. | |
| 2004/0069097 | A1* | 4/2004 | Hauk | E21B 19/165 81/57.16 |
| 2011/0197715 | A1 | 8/2011 | Leicht | |
| 2016/0010406 | A1 | 1/2016 | Henderson et al. | |

* cited by examiner

*Primary Examiner* — James G Sayre
(74) *Attorney, Agent, or Firm* — Avyno Law P.C.

(57) ABSTRACT

A low torque warning system is provided for an apparatus for making and breaking-up pipe connections. The low torque warning system includes a torque cylinder having a poppet valve and torque gauge connected thereto for measuring the pressure in the torque cylinder. A tank in communication with the torque cylinder for receiving oil from the torque cylinder when the poppet valve is opened. The hydraulic valve is then connected to the torque cylinder between the torque cylinder and the tank that when closed prevents the oil in the torque cylinder from draining to the tank, allowing the torque gauge to measure the pressure in the torque cylinder when the poppet valve is open.

6 Claims, 3 Drawing Sheets

LOW TORQUE WARNING TEST AND PRESET SYSTEM

CROSS REFERENCE TO RELATED APPLICATIONS

This application claims priority to U.S. Provisional Patent Application Ser. No. 63/462,555 filed Apr. 28, 2023, titled Low Torque Warning Test and Preset System, which application is incorporated by reference herein in its entirety.

FIELD OF INVENTION

The present invention generally concerns tooling and equipment utilized in the maintenance and servicing of oil and gas production wells, and more particularly relates to an improved low torque warning and preset system to minimize the risk of over-torque or under-torque, damage to drill pipe threads, or loss of drill string.

BACKGROUND

In drilling for oil and gas, it is necessary to assemble a string of drill pipe joints. Thus, a tubular drill string may be formed from a series of connected lengths of drill pipe and suspended by an overhead derrick. These lengths of drill pipe are connected by tapered external threads (the pin) on one end of the pipe and tapered internal threads (the box) on the other end of the pipe.

During the drilling and completion of a well, as the well is drilled deeper, additional joints of pipe are periodically added to the drill string and, as the drill bit at the end of the drill string is worn, the drill string must occasionally be pulled from the well and reinstalled for maintenance purposes. The process of pulling or installing the drill string is referred to as "tripping." During tripping, the threaded connections between the lengths of drill pipe are connected and disconnected as needed. The connecting and disconnecting of adjacent sections of drill pipe (referred to as making or breaking the connection, respectively), involves applying torque to the connection and rotating one of the pipes relative to the other to fully engage or disengage the threads.

In modern wells, a drill string may be thousands of feet long and typically is formed from individual thirty-foot sections of drill pipe. Even if only every third connection is broken, as is common, hundreds of connections are made and broken during tripping. Thus, the tripping process is one of the most time consuming and labor intensive operations performed on the drilling rig.

Currently, there are a number of devices utilized to speed tripping operations by automating or mechanizing the process of making and breaking a threaded pipe connection. These devices include tools known as power tongs, iron roughnecks, and pipe spinners. Many of these devices are complex pieces of machinery that require two or more people to operate and require multiple steps, either automated or manual, to perform the desired operations.

In particular, roughnecks combine a torque wrench and a spinning wrench, simply called a spinner, to connect and disconnect drill pipe joints of the drill string. In most instances, the spinner and the torque wrench are both mounted together on a carriage. To make or break a threaded connection between adjoining joints of drill pipe, certain roughnecks have a torque wrench with two jaw levels. In these devices, an upper jaw of the torque wrench is utilized to clamp onto a portion of an upper tubular, and a lower jaw clamps onto a portion of a lower tubular (e.g., upper and lower threadedly connected pieces of drill pipe). After clamping onto the tubular, the upper and lower jaws are turned relative to each other to break or make a connection between the upper and lower tubulars. A spinner, mounted on the carriage above the torque wrench, engages the upper tubular and spins it until it is disconnected from the lower tubular (or in a connection operation, spins two tubulars together prior to final make-up by the torque wrench).

Over-torque is one of the most common causes of thread damage. Utilizing too much torque will occur when the drill pipe is under torqued before it is run down the hole. When there is not enough torque going into the hole, it will continue to tighten as it goes down, causing it to be over-tightened. The most effective way to avoid over-torque is to ensure all connections are properly tightened to their usage specifications before use so that connections are properly tightened at their designated levels—at the table. In many products, this requires more planning and labor to determine optimum torque values to minimize the risk of over-torque and damage to drill pipe threads.

Certain products may include low torque warning system. For example, in U.S. Pat. No. 6,722,231 (issued to Hawk Industries, Inc.), which patent is incorporated in this application by reference in its entirety, a low torque warning system is described. For example, in the HAWKJAW® product line or the T-WREX® product line, manufactured and sold by Hawk Industries, Inc., the system will warn the operator if the desired torque is not reached. Here, with the torque cylinder retracted, there is a small valve hooked to the cylinder. When the piston extends to a certain point, it hits the poppet pin, and shifts the valve. This dumps the pressure in the gauge so that the needle drops to near zero. The worker thus knows that the joint has not been correctly made up.

In other words, when the torque piston gets all the way up and hits a poppet valve, the valve shifts and dumps the gauge pressure causing the needle of the torque gauge to drop to near zero. This indicates that the pipes have not been fully torqued because if the joint had been made up correctly, the torque gauge will go up in torque until it reaches the preset torque and stop. It will torque to a preset torque unless the torque cylinder is extended all the way out. If it has been torqued and the joint has not been made up by the time the torque cylinder is extended all the way and the torque cylinder hits the end of its stroke, without the low torque warning poppet, the gauge will go up and hold. Thus, the low torque warning system provides that when the torque cylinder is extended and the system is not to a fully torqued position, the needle drops to zero or close to zero to show that the desired torque has not been reached.

Certain other products include a low torque warning test systems. Manufacturers recommend that low torque warning tests be performed on every trip (make up and breaking), otherwise the drill string could be over or under torqued. To test torque values in the HAWKJAW® product line or the T-WREX® product line when making up pipe, an operator must manually uncouple the tank return line on the rear of the HAWKJAW® or on the torque cylinder flange on the T-WREX product line via a quick disconnect. Manually uncoupling this line prevents the dumping of the oil in the torque cylinder back into the tank, which dumps the pressure in the torque gauge. Accordingly, to test the torque, the operator torques the first connection. The torque gauge needle position is recorded. With the equipment in the same position, the line with the quick disconnect is uncoupled. The connection is re-torqued. The torque gauge needle should read the same, otherwise trouble shooting is required to determine and correct the fault.

Manually disconnecting the lines can not only be laborious but can also be problematic due to corrosion of the quick disconnect ("QD") fitting. When the QDs do not operate correctly or the location of the fitting is difficult to reach, it can sometimes make disconnecting the QDs awkward and/or time consuming, sometimes requiring a second person. This oftentimes leads to the test not being performed, which can result in not achieving proper torque applied into the drill pipe joint due to an undiagnosed fault in the low-torque warning system.

A need therefore exists for a simpler way to perform testing in a low-torque warning system so that tests can easily be performed with each trip.

SUMMARY OF THE INVENTION

The present invention provides a low torque warning system designed so that the tests can easily be performed with each trip using existing controls of the equipment. By using existing controls of the tool to perform the test, performing the necessary testing becomes considerably easier, safer and quicker and provides enhanced functionality and diagnostic troubleshooting of the equipment.

A low torque warning system is provided for an apparatus for making and breaking-up pipe connections. The low torque warning system includes a torque cylinder having a poppet valve and torque gauge connected thereto for measuring the pressure in the torque cylinder. A tank in communication with the torque cylinder for receiving oil from the torque cylinder when the poppet valve is opened. The hydraulic valve is then connected to the torque cylinder that when closed prevents the oil in the torque cylinder from draining to the tank, allowing the torque gauge to measure the pressure in the torque cylinder.

The hydraulic valve in the low torque warning system is positioned on a tank return line, which allows the oil in the torque cylinder to dump into the tank when the poppet valve is opened. The hydraulic valve is connected to the torque cylinder between the tank and the torque cylinder by the tank return line.

In one example, the hydraulic valve is actuated pneumatically. The low torque warning system further includes a control panel connected to a manifold for controlling the operation of the apparatus, where the control panel further includes a switch for pneumatically activating the hydraulic valve.

In another example, the hydraulic valve of the low torque warning system may be integrated into a manifold or rely, in which case, the manifold connects directly to the torque cylinder via a tank return line. In yet another example, the hydraulic valve may be a retrofit and be connected to the torque cylinder at one end and the manifold at the other end. In this case, the hydraulic valve is connected to the control panel for controlling the hydraulic valve, for example, pneumatically through an airline.

As shown and explained further in this application, the present invention provides safety, convenience, and speed of test operations by eliminating the need to manually disconnect the tank return line from the system. The hydraulic valve can also be used to rapidly verify the function of the poppet valve in the torque cylinder by fully extending the torque cylinder off the drill pipe and actuating the hydraulic valve to visually verify the pressure on the torque gauge. Once pressure is verified, the apparatus can be brought onto the drill pipe to torque the first connection. Again, before the apparatus is removed from the drill pipe, the hydraulic valve should be actuated again to observe that the torque obtained with the hydraulic valve actuated and not actuated are the same to diagnose possible faults in the system, such as the poppet valve leaking pressure, which would cause inaccurate torque readings.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

DESCRIPTION OF FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION OF THE INVENTION

The present invention relates to an improved low torque warning test and preset system integrated into apparatuses and methods for making (torquing up the connection) and/or breaking (breaking out the connection) joints in drill pipe strings, including systems for spinning pipes (up to the shoulder or to refusal such as for tapered connections). Examples of such apparatus include but are not limited to the HAWKJAW® and the T-WREX® made and sold by Hawk Industries, Inc.

Figure 1:
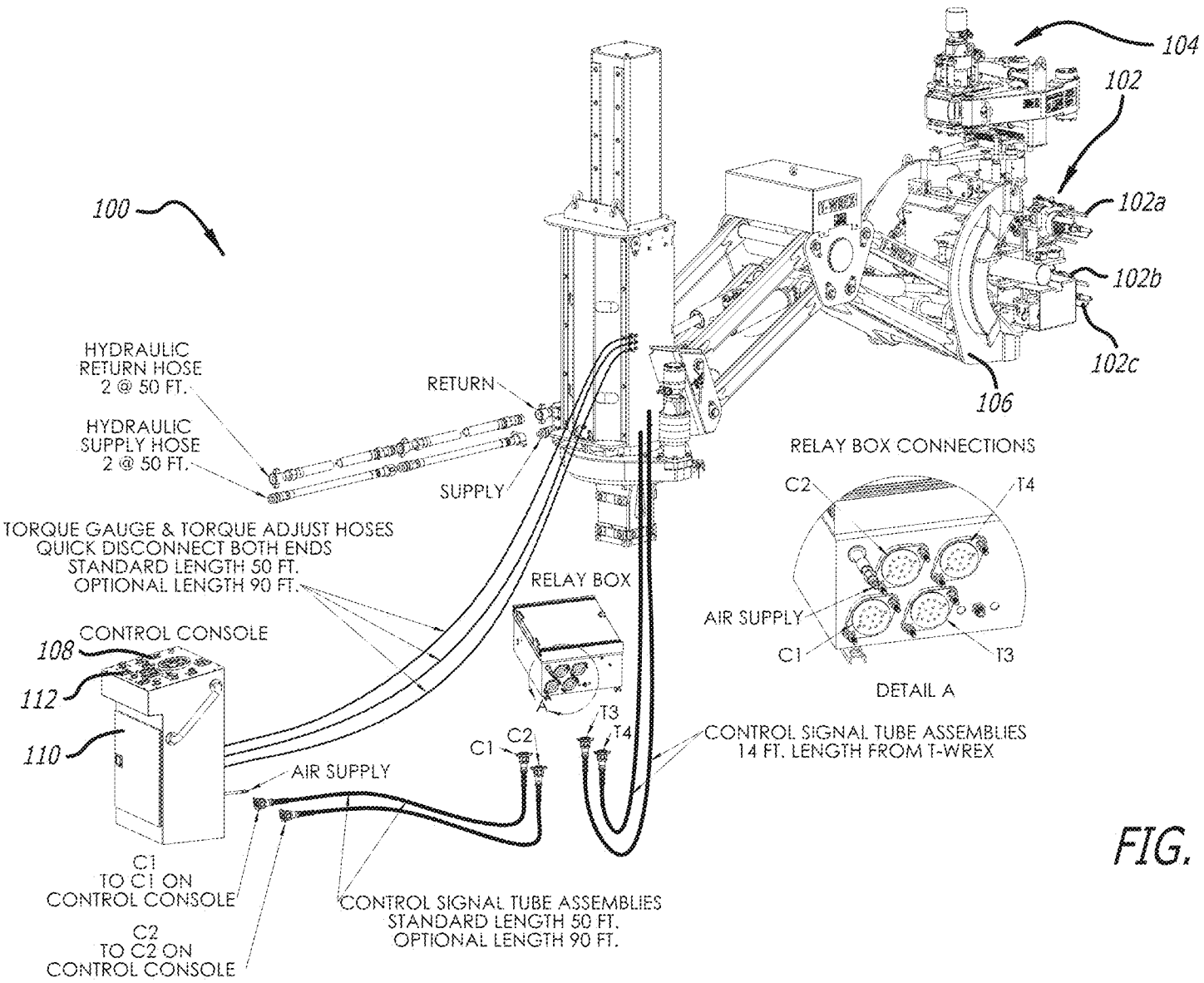
FIG. 1 is a side view of a drill pipe make and break up apparatus.

FIG. 1 is a side view of a drill pipe make and break-up apparatus 100, which in this illustration is the T-WREX®. Although the HAWKJAW® is not illustrated, both the HAWKJAW® and T-WREX® include a structural frame supporting three wrenches (or jaws or grippers) 102 (a top 102*a*, middle 102*b* and bottom 102*c* wrench) aligned one on top of the other. The top and bottom wrenches 102*a*, 102*c* are in the same orientation, and the middle wrench 102*b* is in a flipped over orientation. Each of the jaws 102 is operated in only one direction and is self-energizing. All uniquely allow the drill pipe string to be made up (torqued up) and to be broken out using the same machine and without having to reposition the wrenches 102 relative to the frame 106 for the different operations. Further, a spinner 104 can be provided at the top of the frame 106 to spin the top pipe section out of the drill pipe string once the wrenches 102 have broken the joint connection.

On the make-up cycle of the apparatus, the structural frame 106 moves about the centerline of the drill pipe string. A torque cylinder is provided on the structural frame 106 to apply torque to the wrenches 102. The torquing load is placed on the middle wrench 102*b* and either the top or bottom wrench 102*a*, 102*c* by the hydraulic torque cylinder.

When the apparatus is in the "make" mode the middle wrench 102*b* is gripped on the bottom pipe section and the top wrench 102*a* is gripped on the top section, and when in the "break" mode the bottom wrench 102*c* is on the bottom section and the middle wrench 102*b* is on the top pipe. (Alternatively, the middle and top wrenches 102*a*, 102*b* can be mirror images of the orientations as disclosed herein and the middle wrench 102*b* can be flipped over compared to the orientation disclosed. Then the middle and top wrenches 102*a*, 102*b* will be used for break and the middle and bottom for make.)

A "grip hold" function 108 is provided by the present invention on the control console 110 such that when a grip hold button 108 (or the like) is pushed, as by the machine's operator, to its "on" position the wrench 102 on the bottom pipe section remains gripped during the number of needed torquing operations of the wrench 102 on the upper pipe section, because of a unique pneumatic/hydraulic system. The grip hold button 108 (or lever, switch or other type of actuator) when actuated holds the bottom wrench 102*c* on the break cycle and the middle wrench 102*b* in the make cycle. Similarly, a "grip" button 112 holds the middle wrench 102*b* on the break cycle and the top wrench 102*a* on the make cycle. When the grip hold button 108 is de-energized, the grip button 112 is rendered inoperative.

As mentioned, a number of different torquing operations of the wrench are needed to perform during both the "make" and "break" modes. As stated previously, over torquing will damage the pipes. The most effective way to avoid over-torque is to ensure all connections are properly tightened to their usage specifications before use. The present invention allows such testing to be automated.

Figure 2:
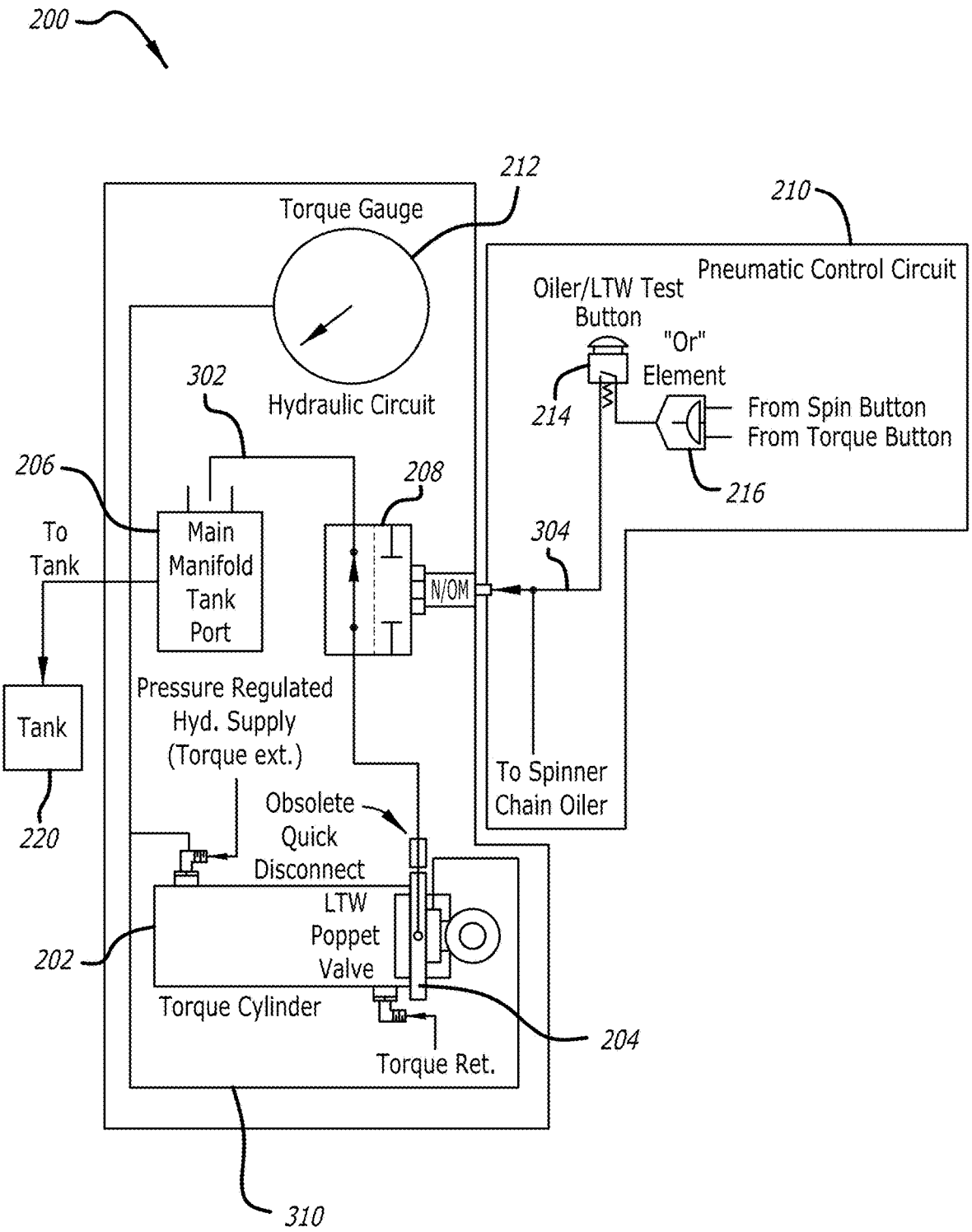
FIG. 2 is a schematic diagram of the low torque warning test and preset system of the present invention.

FIG. 2 is a schematic diagram of the low torque warning test and preset system 200 of the present invention. As illustrated in FIG. 2, the torque cylinder 202 includes a poppet valve 204 that functions as a low torque warning system. When the torque cylinder 202 is fully extended, the poppet valve 204 opens, normally allowing the pressure to drain to the tank 220 through the main manifold tank port 206 (i.e., a manifold having a tank port).

In the present invention, a hydraulic valve 208 is added to the system that can be pneumatically actuated via the control circuit 210, which acts to block the flow to the tank 220 through the main manifold tank port 206. The hydraulic valve 208 is normally open allowing for the pressure to drain to the tank 220. However, when actuated, the hydraulic valve 208 is closed and the flow is blocked, allowing for the pressure to register on the torque gauge 212. In other words, the oil flow from the poppet valve 204 within the torque cylinder 202, which would normally allow the torque gauge 212 to drop indicating that the torque cylinder had reached full stroke by draining to the tank 220, is blocked. With the flow to tank 220 blocked, the pressure from the torque cylinder 202 is then shown on the torque gauge 212.

As shown in FIG. 2, a low torque test button 214 can be included on the controller 110 (FIG. 1) which can be an added button or a button shared with the oiler as shown in FIG. 2. When shared with the oiler button, the LTW test button can only be actuated if the oiler button is disengaged (i.e., when the spin button 216 is not depressed).

The new pneumatically actuated hydraulic valve 208 can be added in-line between the current main manifold 206 of the apparatus (i.e., as a retrofit) and the torque cylinder 202 or can be added to the main manifold 206 for newly designed apparatus. New manifolds 206 with the hydraulic valve 208 integrated could also be installed in place of the old manifolds. In either case, the oiler button 214 on the control circuit 210, which is actuated when the spin button or torque button 216 is engaged, may be used as the low torque test button 214, as the low torque test button 214 would only be utilized when the oiler button is disengaged. Alternatively, a new LTW test button could be added to the control circuit 210 separate from the oiler button.

In operation, when the LTW test valve 214 is actuated, the poppet valve 204 is closed allowing the pressure in the torque cylinder 202 to measure on the torque gauge 212. By actuation of the LTW test valve 214, an operator can now pre-set the torque required for the tool joint of the drill pipe being used and test the torque before bringing the unit onto the drill pipe. In addition, the function of the low torque warning system (which is triggered when the torque cylinder reaches full stroke before the desired torque is meet) can be verified rapidly and without further assistance during the pre-setting of the desired torque and during the initial making up of a section of the drill string.

Figure 3:
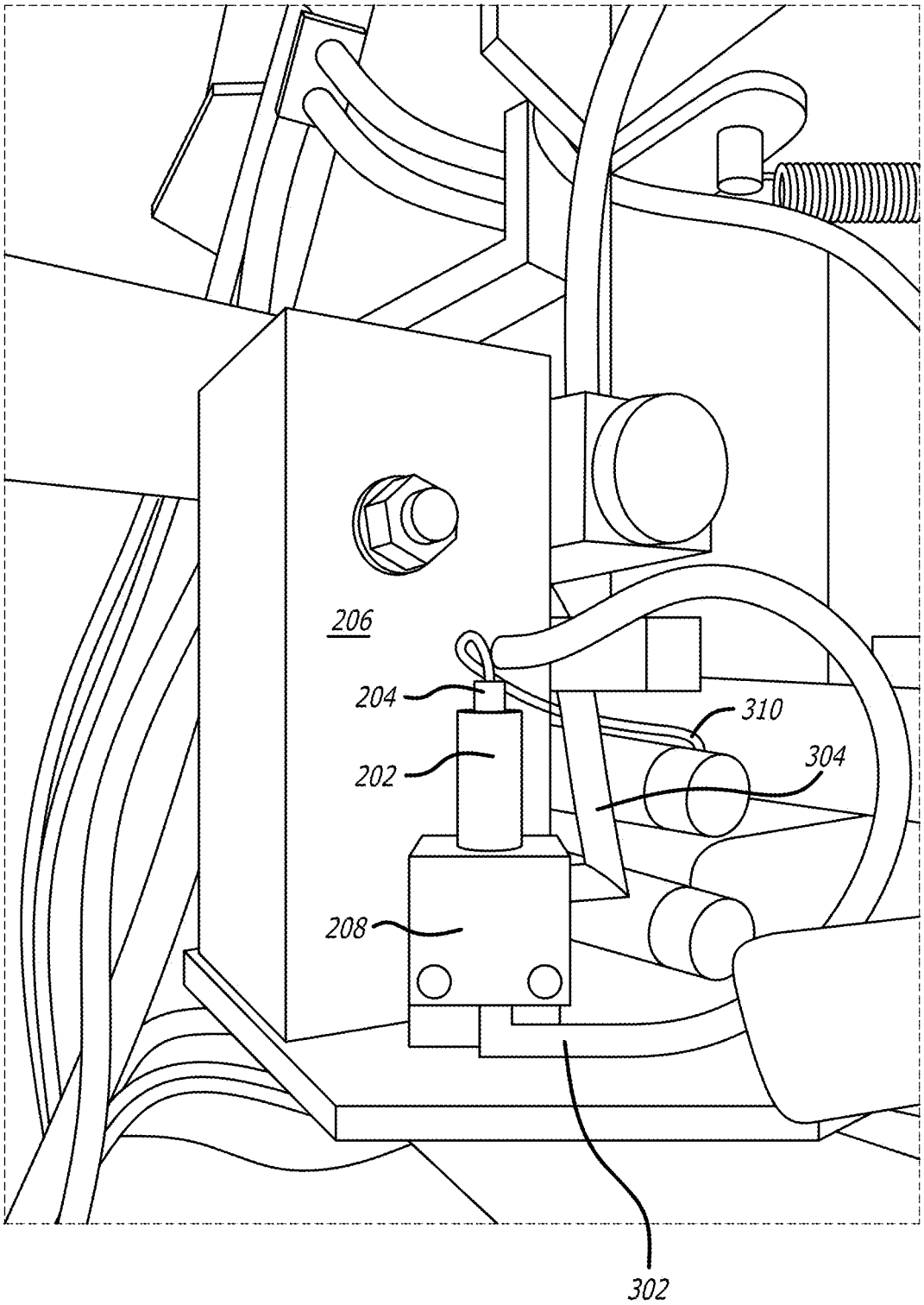
FIG. 3 is a side view of a retrofit system of the present invention.

FIG. 3 is a side view of a hydraulic valve 208 retrofitted on a manifold or relay of an apparatus. As shown, the hydraulic valve 208 includes an inlet from the torque cylinder 204 (via connection of the two parts), the flow of which is blocked upon actuation of the hydraulic valve 208, an outlet 302 to the main manifold/tank port 206, and an air supply line 304 to pneumatically actuate the hydraulic valve 208 from the control console. As explained above, the hydraulic valve 208 of the present invention may also be included in the manifold or relay box. Further, an air line 310 is also shown which communicates or runs to the torque gauge 212.

The foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. A low torque warning system for an apparatus for making and breaking-up pipe connections, the low torque warning system including:

a torque cylinder having a poppet valve;

a torque gauge connected to the torque cylinder for measuring the pressure in the torque cylinder;

a tank connected to the torque cylinder for receiving oil from the torque cylinder when the poppet valve is opened;

a manifold having a hydraulic valve and where the manifold is connected to the torque cylinder, where the hydraulic valve when closed prevents the oil in the torque cylinder from draining to the tank; and a control panel connected to the manifold for controlling the operation of the low torque warning system, the control panel having a switch for activating the hydraulic valve of the manifold.

2. The low torque warning system of claim 1 where the hydraulic valve is actuated pneumatically.

3. A low torque warning system for an apparatus for making and breaking-up pipe connections, the low torque warning system including:

a torque cylinder having a poppet valve;

a torque gauge connected to the torque cylinder for measuring the pressure in the torque cylinder;

a tank connected to the torque cylinder for receiving oil from the torque cylinder when the poppet valve is opened;

a hydraulic valve connected to the torque cylinder at one end and a manifold at the other end, where the hydraulic valve when closed prevents the oil in the torque cylinder from draining to the tank; and the hydraulic valve being further connected to a control panel for controlling the operation of the hydraulic valve, the control panel having a switch for activating the hydraulic valve.

4. The low torque warning system of claim 3 where the hydraulic valve is actuated pneumatically.

5. A low torque warning system for an apparatus for making and breaking-up pipe connections, the low torque warning system including:

a torque cylinder having a poppet valve;

a torque gauge connected to the torque cylinder for measuring the pressure in the torque cylinder;

a tank connected to the torque cylinder for receiving oil from the torque cylinder when the poppet valve is opened;

a hydraulic valve connected to the torque cylinder between the tank and the torque cylinder by a tank return line, where the hydraulic valve, when closed, prevents the oil in the torque cylinder from draining to the tank;

a control panel connected to a manifold for controlling the operation of the hydraulic valve, the control panel having a switch for activating the hydraulic valve.

6. The low torque warning system of claim 5 where the hydraulic valve is actuated pneumatically.

* * * * *